US007207456B2

(12) United States Patent
Pick

(10) Patent No.: US 7,207,456 B2
(45) Date of Patent: Apr. 24, 2007

(54) CONTAINER FOR TWO-CYCLE ENGINE FUEL

(76) Inventor: Chris Pick, 3638 Lake St., Kalamazoo, MI (US) 49001

( * ) Notice: Subject to any disclaimer, the term of this patent is extended or adjusted under 35 U.S.C. 154(b) by 69 days.

(21) Appl. No.: 10/984,295

(22) Filed: Nov. 9, 2004

(65) Prior Publication Data

US 2005/0161423 A1 Jul. 28, 2005

Related U.S. Application Data

(60) Provisional application No. 60/539,679, filed on Jan. 28, 2004.

(51) Int. Cl.
*B65D 21/02* (2006.01)

(52) U.S. Cl. ..... 220/23.86; 9/549; 9/652; 9/739

(58) Field of Classification Search ..... D9/738, D9/739, 600–680; 220/23.8, 737, 669
See application file for complete search history.

(56) References Cited

U.S. PATENT DOCUMENTS

D79,455 S * 9/1929 Blunt ..... D9/652
3,225,951 A * 12/1965 Poston et al. ..... 215/6
3,658,204 A * 4/1972 Bottger ..... 220/23.4
4,235,343 A * 11/1980 Thompson ..... 215/6
4,592,478 A * 6/1986 Laconis ..... 220/23.83
D310,958 S * 10/1990 Biesecker ..... D9/744
D319,577 S * 9/1991 Schwarz ..... D9/652
5,050,757 A * 9/1991 Hidding et al. ..... 220/23.83
5,123,460 A * 6/1992 Reed ..... 141/95
D339,961 S * 10/1993 Ravelo et al. ..... D7/515
5,447,245 A * 9/1995 Merhar ..... 215/6

* cited by examiner

*Primary Examiner*—Jes F. Pascua
*Assistant Examiner*—Eugene Lhymn
(74) *Attorney, Agent, or Firm*—Gifford, Krass, Groh, Sprinkle, Anderson & Citkowski, P.C.

(57) ABSTRACT

A container for gasoline for use in a two-cycle engine has indentations formed on its four sides so that when viewed from any of the four sides it presents the appearance of the Arabic numeral two, indicating that it is for use with two-cycle engine fuel. The container includes a recess in one of its sidewalls for receiving a smaller container for oil for mixing with the gasoline before insertion in the engine. The oil container may be similarly contoured to give the appearance of the Arabic numeral two.

8 Claims, 5 Drawing Sheets

FIG - 9
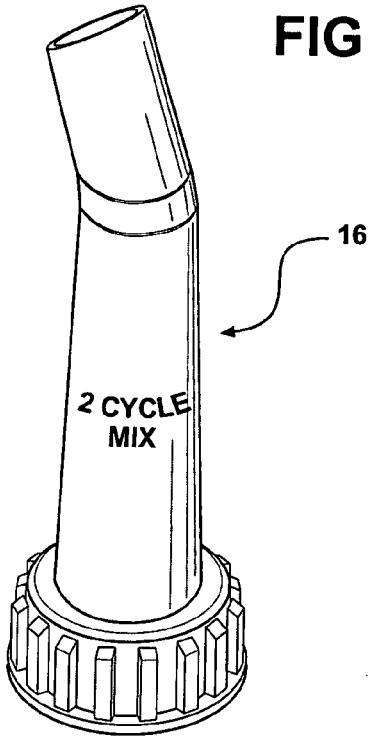
FIG - 10
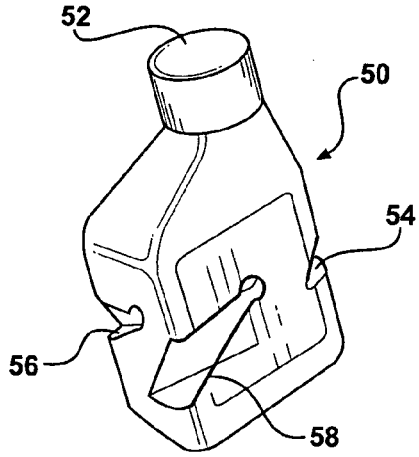
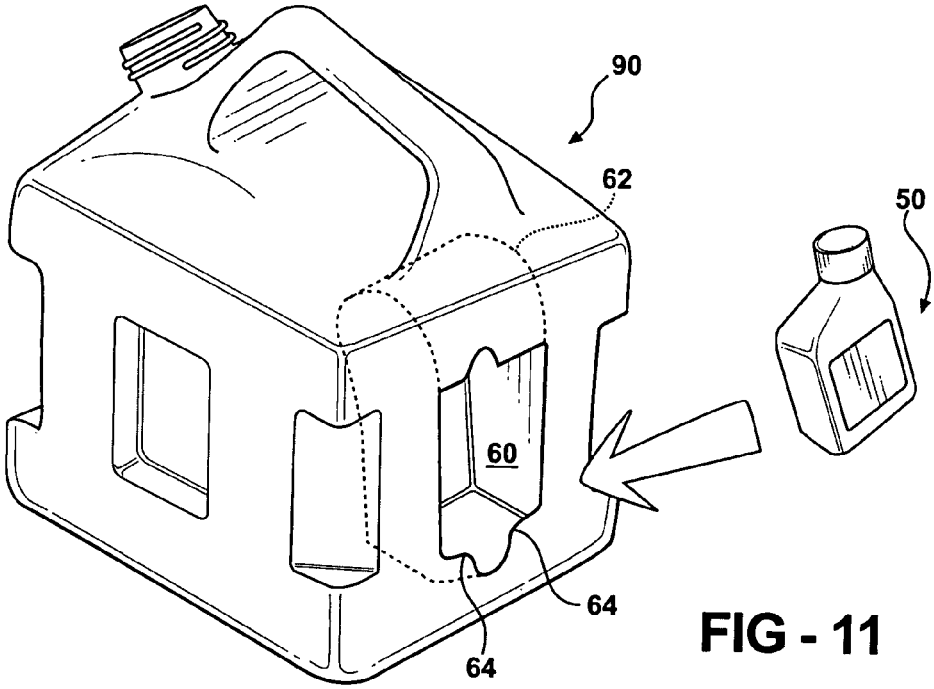
FIG - 11

CONTAINER FOR TWO-CYCLE ENGINE FUEL

RELATED APPLICATION

This application claims priority of U.S. Provisional Patent Application Ser. No. 60/539,679 filed Jan. 28, 2004, which is incorporated herein by reference.

FIELD OF THE INVENTION

This invention relates to a container that holds both the gasoline and oil required by two-cycle engines, and more particularly to a gasoline container having a unique configuration which alerts the user that it is intended for use with two-cycle fuel and includes a recessed opening on a sidewall of the container for receiving a can of two-cycle oil to be mixed with the gasoline.

BACKGROUND OF THE INVENTION

While four-cycle gasoline engines of the type commonly used in automobiles and trucks include reservoirs which are filled with oil and pumps for distributing the oil to lubricate the operation of the engine, two-cycle engines do not include separate oil reservoirs. The lubricating oil is rather mixed with the gasoline for powering the engine. When the gasoline is carbureted into the two-cycle engine's cylinders, it also provides the necessary lubrication.

Two-cycle engines are typically employed to power relatively small, portable devices such as marine outboard engines, lawnmowers, chainsaws or the like, and these smaller engines are not filled with gasoline directly from a pump as are the four-cycle engines of automotive vehicles. Rather, they are typically filled from small containers which might hold between one and five gallons of gasoline. The containers are typically filled with gasoline directly from a pump, and the lubricating oil is provided in separate small containers of approximately one or two pint capacity. An appropriate amount of lubricating oil is added into the gasoline container, and mixed with the gasoline, before the two-cycle engine is filled with the mixture.

Not uncommonly, operators of two-cycle engines forget to mix oil with the gasoline, causing damage to the engine. Occasionally, a mixture of gasoline and lubricating oil intended for two-cycle engines will be added to four-cycle engines, which may result in improper operation of the engine, excessive smoke from the exhaust, or possibly damage to the engine.

SUMMARY OF THE INVENTION

The present invention is accordingly directed toward a container for gasoline intended to be used with two-cycle engines which is specialized in design to clearly distinguish it as a two-cycle engine gasoline container to minimize the possibility of use of its contents with four-cycle engines. More particularly, the present invention is directed toward a container which includes a recess in one of its sidewalls which allows the insertion of a smaller container of two-cycle engine oil intended for mixing with the gasoline before use, so that both the gasoline and the oil may be stored and transported as a single unit.

The preferred embodiment of the container of the present invention, which will be subsequently disclosed in detail, is uniquely contoured so as to give the appearance of the Arabic numeral two when viewed from either side, the front or the back, to unequivocally identify the nature of its contents and its intended use. The contoured configuration is such as to allow the container to be produced by conventional blow molding processes which are extremely economical. Thus, the container of the present invention costs no more than a conventional plastic gasoline container but serves the added function of uniquely identifying the nature of its contents and intended use. Alternatively, the container of the present invention could be formed out of sheet metal, again only requiring the special dies, or any other material suitable for containing petrolium based fluids.

Since a quantity of lubricating oil, smaller in volume than the gasoline, must be mixed with the gasoline before use, the container of the present invention includes a recess in one of its sidewalls, preferably the rear wall, which allows the insertion and secure retention of a smaller container of two-cycle engine oil, intended for mixing with the gasoline before use, in order to allow the storage and transport of both the required gasoline and lubricating oil as a single unit.

BRIEF DESCRIPTION OF THE DRAWINGS

Other objects, advantages and applications of the present invention will be made apparent by the following detailed description of the preferred embodiment of the invention. The description makes reference to the accompanying drawings, in which:

FIG. 9 is a perspective view of a dispensing spout for use with the inventive container;

FIG. 10 is a perspective view of an oil container formed in accordance with the present invention; and FIG. 11 is an alternative embodiment of the invention wherein the gasoline container is contoured so as to resemble the Roman numeral two.

DETAILED DESCRIPTION OF THE INVENTION

Figure 1:
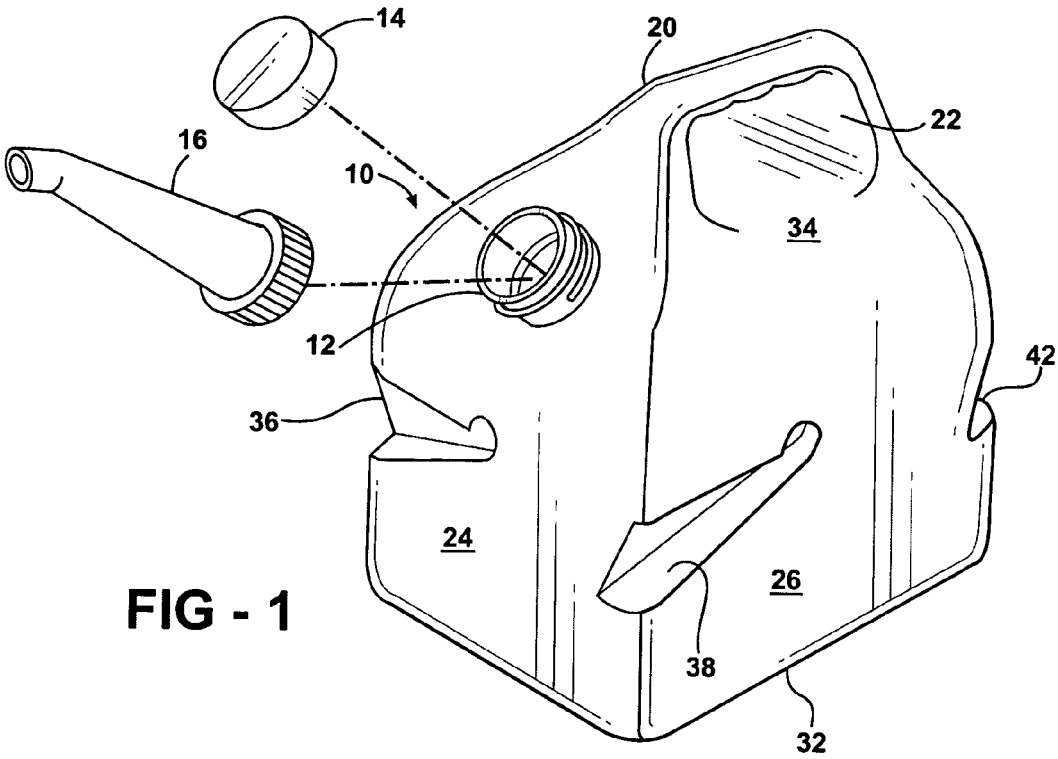
FIG. 1 is a front perspective view of a container constituting a preferred embodiment of my invention.
Figure 2:
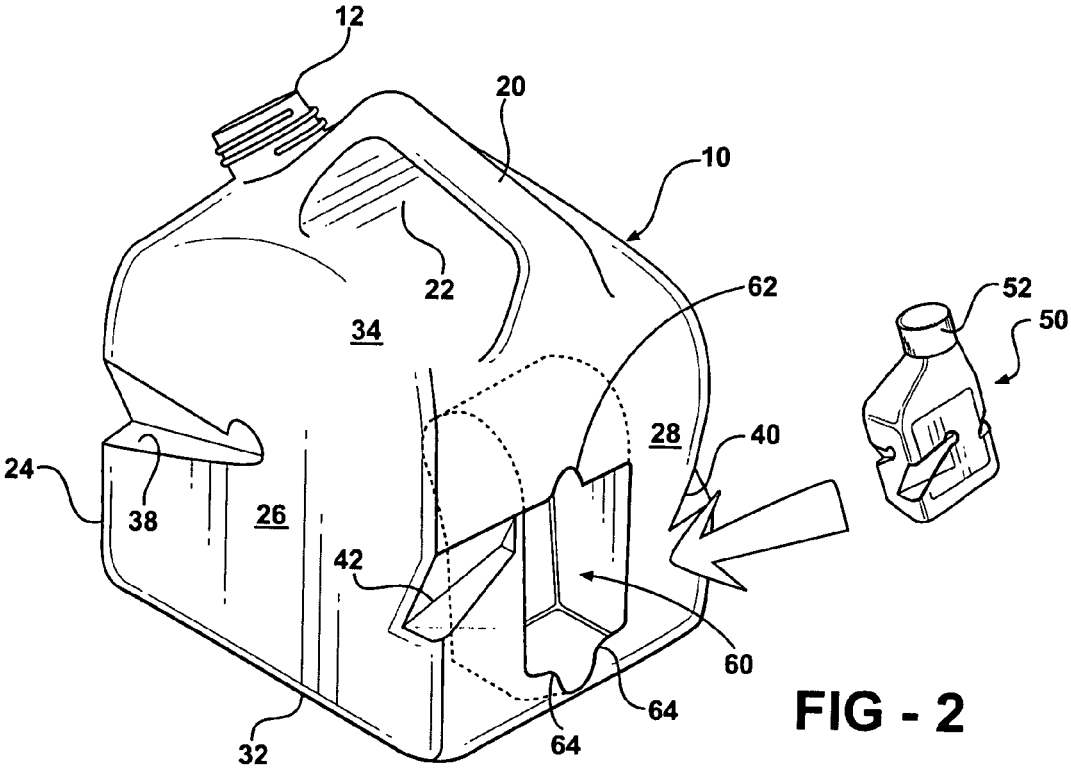
FIG. 2 is a rear perspective view of the container of FIG. 1.
Figure 3:
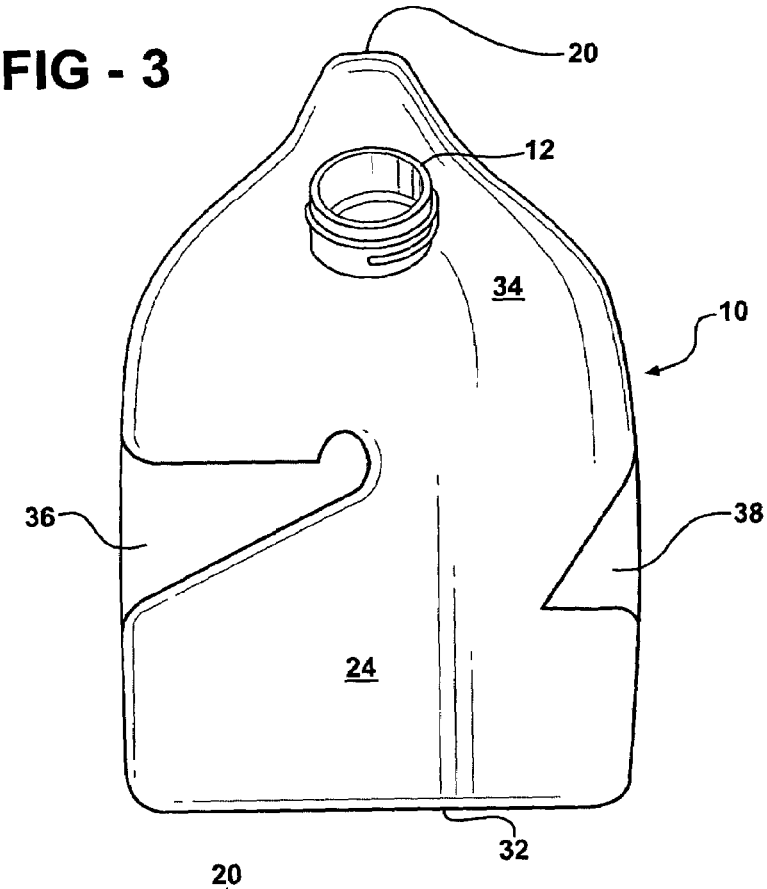
FIG. 3 is a front view of the container of FIG. 1.
Figure 4:
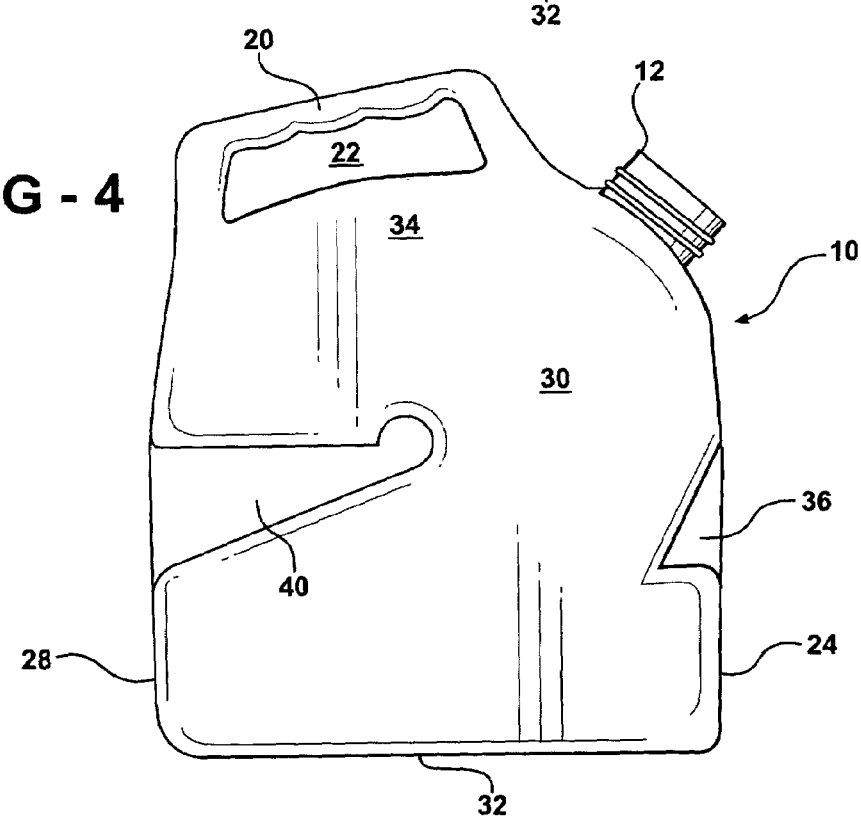
FIG. 4 is a left side view of the container of FIG. 1.
Figure 5:
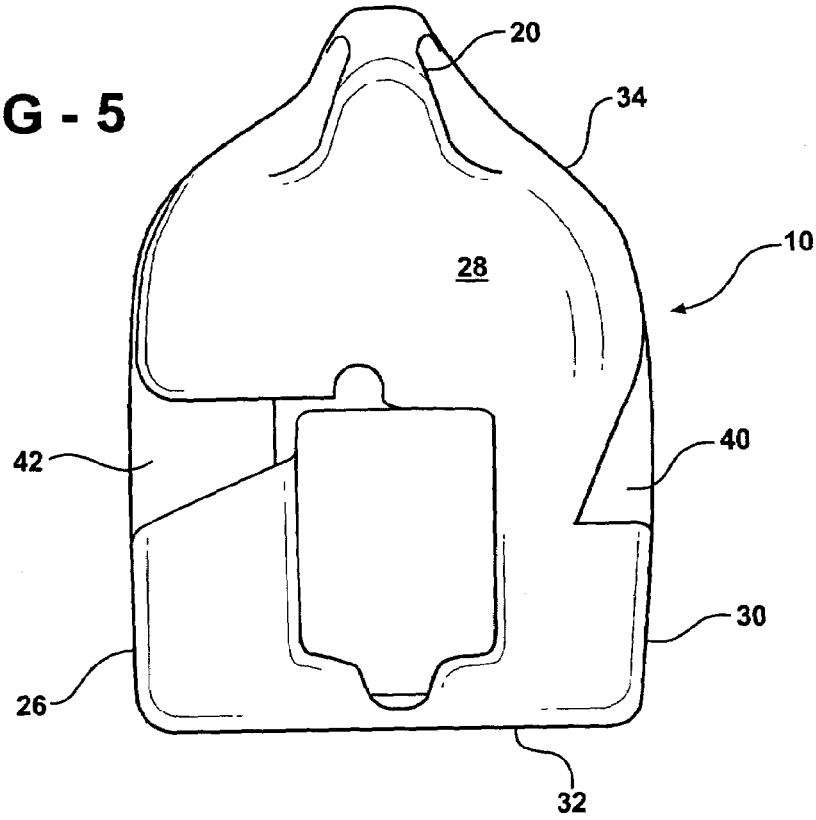
FIG. 5 is a rear view of the container of FIG. 1.
Figure 6:
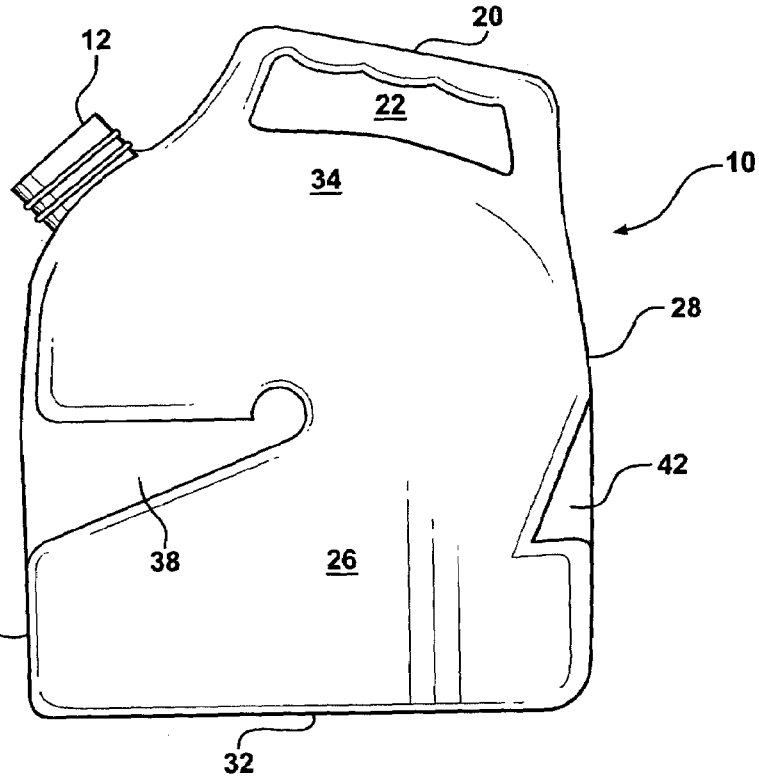
FIG. 6 is a right-side view of the container of FIG. 1.
Figure 7:
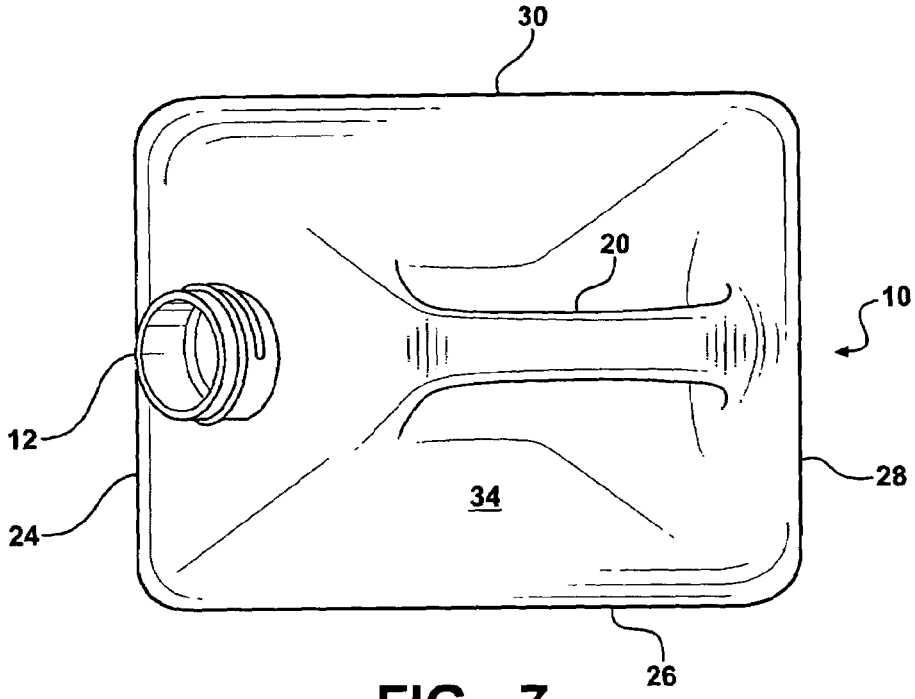
FIG. 7 is a top view of the container of FIG. 1.

The container of the present invention, generally indicated at 10 in FIG. 1, is preferably blow molded of an appropriate plastic such as polyethylene and is colored red in accordance with the convention of gasoline containers. Alternatively, the container 10 can be stamped and fabricated out of sheet metal and painted with the red color. The container is intended to be hand carried. The container might be designed to hold anywhere between one and five gallons of gasoline, with one, one and one-half, two, two and one-half, or five gallon containers being the most popular sizes. Larger sizes could be formed.

The container, generally at 10 in FIG. 1, is generally rectangular in configuration. The interior of the container is hollow and access to the container is through a male threaded port 12 on the upper side. The port 12 may be closed with a conventional female threaded cap 14. Alternatively, a spout, generally indicated at 16 in FIG. 9, may be attached to the port 12 to allow the contents to be poured into the tank of a two-cycle engine.

The top of the container has a molded handle 20 extending over a central depression 22 above the container body. The container has a front side 24, a right 26 side, a rear side 28, a left side 30, a bottom 32, and a top 34, preferably with rounded edges joining the four sides. The preferred embodiment of the invention is contoured so as to present the Arabic numeral two when viewed from any of its four sides. Alternative embodiments could be contoured so as to present the Roman numeral two, as illustrated in the container generally indicated at 90, in FIG. 11, or could be imprinted with either the Arabic or Roman numeral two or other variations thereon. The contouring or imprinting could be limited to one or more selected sides.

To provide the appearance of the Arabic numeral two on any of the four sides, a first indentation 36 extends from the front wall 24 through the left wall 30. A second indentation 38 extends from the front wall 24 through the right side wall 26. A third indentation 40 extends from the back side 28 through the left side 30. A fourth indentation 42 extends from the rear of the right side 26 through the rear side. This configuration, providing the container with the appearance of the Arabic numeral two from all four sides, prominently brings to the attention of the users that the purpose of the container is to store two-cycle gasoline.

Oil to be mixed with gasoline in the container 10 is provided in a smaller bottle, preferably of one or two pint size, generally indicated at 50 in FIG. 10. This bottle, preferably formed of plastic by a blow molding process, or alternatively of sheet metal, has a screw cap 52. The sidewalls of the bottle 50 are preferably contoured in the same way as the sidewalls of the container 10 with a first indentation 54 extending from the front wall to one sidewall, a second indentation 56 extending from the rear wall to the opposed sidewall, and a third indentation 58 extending from one sidewall to the rear. Another indentation, not visible in FIG. 10, gives the completed configuration of the Arabic numeral two to all four sides.

The oil bottle 50 is adapted to be retained within a recess generally indicated at 60 formed in the rear wall of the container 10. The recess has an extension 62 on its top side adapted to receive the cap 52 of the container 10. It has a pair of keeper walls 64 extending upwardly from the outer side of the bottom wall of the recess 60 at its opposite edges. The container 10 is inserted into the recess 60 by inclining the container so that its bottom end clears the keeper walls 64 and then straightening the container so it is in an upright position and retained against displacement by the keeper walls 64.

Figure 8:
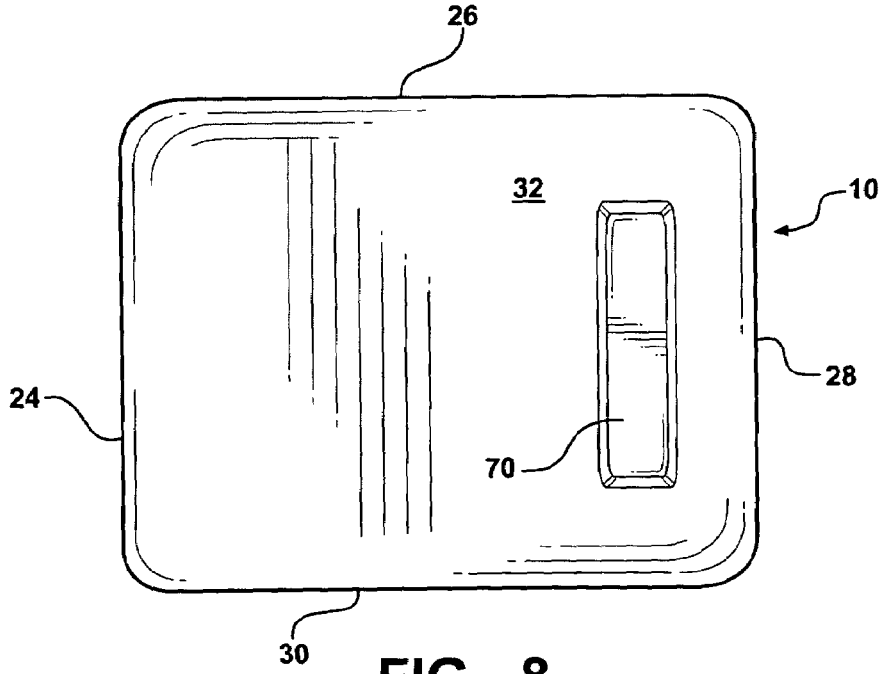
FIG. 8 is a bottom view of the container of FIG. 1.

The bottom 32 as illustrated in FIG. 8, has a laterally extending indentation 70, which acts as a hand grip.

When the contents of the two containers 10 and 50 are to be used to fill a two-cycle engine, the container 50 is removed, the cap 14 is removed from the port 12, and the contents of the container 50 are poured into the main container 10. The cap 16 is then replaced, the container is shaken to mix the oil with the gasoline, and the cap 14 is removed and replaced with a pouring spout 16. The contents are then poured into the gas tank of the two-cycle engine. In alternate embodiments of the invention, other physical arrangements could be provided to retain the oil container 15 in a unitary manner with the gasoline container 10.

Alternate forms of contouring or imprinting could be utilized to clearly identify to users the nature of the container as being intended for two-cycle gasoline.

Having thus described my invention I claim:

1. A container system, comprising:

a first, relatively large container for gasoline for use in a two-cycle engine, comprising:

a hollow container having four sides, a bottom and a top and having a port formed in the top with a screw thread formed about its edges for introducing or removing fluid from the container, the container having a contoured configuration in the form of the numeral two, as the container is viewed from any of its four sides, adapted to identify it as a container for two-cycle engine fluid and a recess within one of its sides; and a second, relatively small container for oil to be mixed with the gasoline, having dimensions such that it may fit within the recess.

2. The container of claim 1 wherein the contouring represents the Roman numeral two.

3. The container of claim 1 wherein the recess has a pair of keeper walls formed in its exterior sides so that a container for oil may be inserted into the recess by inclining it and then moving it to an upright position and the keeper walls retain the container for oil against displacement within the recess.

4. The container of claim 1 wherein the second smaller container for oil for mixing with gasoline from the first container is contoured so as to present information indicating that it is intended for use within two-cycle engine fuel.

5. The container of claim 1 wherein both the first container and the second smaller container are contoured so as to present the appearance of the Arabic numeral two to users when viewed from any of the four sides.

6. The container of claim 1 which is formed of plastic by a blow molding process.

7. The container of claim 1 wherein the recess in one of the walls of the container adapted to receive the second smaller container for oil for mixing with gasoline from the first container includes a pair of keeper walls extending into the recess so that the second container may be inserted into the recess by inclining the container and then moving it to an upright position wherein it is retained by the keeper walls against displacement.

8. The container of claim 1 wherein the contouring represents the Arabic numeral two.

* * * * *